US005701608A

United States Patent [19]

Kohn

[11] Patent Number: 5,701,608

[45] Date of Patent: Dec. 30, 1997

[54] UNDERGARMENT APPARATUS AND METHOD FOR REDUCING MENSTRUAL CRAMPING

[76] Inventor: Joel M. Kohn, 1424 Polk St., Apt. #51, San Francisco, Calif. 94109

[21] Appl. No.: 515,163

[22] Filed: Aug. 15, 1995

Related U.S. Application Data

[63] Continuation-in-part of Ser. No. 143,925, Oct. 27, 1993.

[51] Int. Cl.[6] ..... A41C 1/08; A41C 1/12; A41B 9/00

[52] U.S. Cl. ..... 2/406; 2/400; 2/401; 2/247; 450/114; 450/132; 450/149; 450/150; 450/155; 128/107.1; 128/112.1; 128/120.1

[58] Field of Search ..... 2/73, 400, 401, 2/402, 403, 404, 405, 406, 407, 408, 409, 310, 311, 312, 338, 300, 247, 248, 249, 250, 281, 252; 450/48, 99, 114, 129, 132, 133, 134, 135, 136, 146, 148, 149, 150, 151, 155; 128/96.1, 99.1, 106.1, 107.1, 109.1, 111.1, 112.1, 117.1, 120.1; 606/201, 204; 602/19; 604/385.2

[56] References Cited

U.S. PATENT DOCUMENTS

| | | | |
|---|---|---|---|
| 1,600,178 | 9/1926 | Hussey | 128/96.1 |
| 2,018,981 | 10/1935 | Tietjen | 128/96.1 |
| 2,654,366 | 10/1953 | Miller | 128/107.1 |
| 3,393,674 | 7/1968 | Nelkin | 128/96.1 |
| 3,577,986 | 5/1971 | Regent | 128/107.1 |
| 4,122,552 | 10/1978 | Tedford | 2/402 |
| 4,671,264 | 6/1987 | Frangi | 128/96.1 |
| 4,675,918 | 6/1987 | O'Brien | 2/402 |
| 4,937,887 | 7/1990 | Schreiner | 2/402 |
| 4,957,105 | 9/1990 | Kurth | 128/96.1 |
| 5,383,893 | 1/1995 | Daneshvar | 128/96.1 X |
| 5,388,274 | 2/1995 | Glover et al. | 128/96.1 X |
| 5,528,775 | 6/1996 | Marenda | 2/406 |
| 5,551,093 | 9/1996 | Stricker | 2/400 X |

FOREIGN PATENT DOCUMENTS

| | | | |
|---|---|---|---|
| 1198902 | 7/1970 | United Kingdom | 2/402 |
| 2195230 | 4/1988 | United Kingdom | 2/400 |
| 2208263 | 3/1989 | United Kingdom | 2/400 |

OTHER PUBLICATIONS

Gach, M. R., "Acupressure's Potent Points: A Guide to Self-Care for Common Ailments", pp. 168–169 (1990).

Travell, J. G., et al., "Myofascial pain and Dysfunction: The Trigger Point Manual", p. 665 (1988).

Lark, S. M., "Premenstrual Syndrome Self-Help Book: A Woman's Guide to Feeling Good all Month", pp. 176, 194 (1984).

Illustrations by Gage, S., "A New View of a Woman's Body", p. 99 (1981).

*Primary Examiner*—Jeanette E. Chapman

*Attorney, Agent, or Firm*—Flehr Hohbach Test Albritton & Herbert

[57] ABSTRACT

An undergarment apparatus (20) and method for reducing menstrual cramping includes an elastic panel (30) mounted to at least one of a front portion (24) and a rear portion (25) of an underpant brief (21) in a manner exerting inward pressure across a lower torso region (31) of an individual wearer (23). At least one movable pressure bearing insert (32) is formed for positioning between the elastic panel (30) and the lower torso region (31) at a plurality of positions along the elastic panel (30). The elastic panel (30) cooperates with an apex portion (33) or small area side of the pressure bearing insert (32) to exert substantial localized point pressure on a relatively small area of the torso region (31) for mitigation of menstrual cramping.

19 Claims, 5 Drawing Sheets

UNDERGARMENT APPARATUS AND METHOD FOR REDUCING MENSTRUAL CRAMPING

RELATED APPLICATION

This application is a continuation-in-part application based upon parent application Ser. No. 08/143,925, filed Oct. 27, 1993 and entitled UNDERGARMENT APPARATUS AND METHOD FOR REDUCING MENSTRUAL CRAMPING.

TECHNICAL FIELD

The present invention relates, generally, to undergarments and, more particularly, relates to undergarment apparatus for reducing menstrual cramping.

BACKGROUND ART

It has long been known that dysmenorrhea or Premenstrual Syndrome (PMS) can be a very discomforting and exhaustive experience for a woman. This is especially true when menstrual cramping becomes so severe that it impedes or interferes with her normal everyday activities. Moreover, chronic menstrual cramping and associated abdominal discomfort can lead to fatigue, mental depression, agitation and short temperament.

While these symptoms have always existed, few forms of relief exist; the most common of which are ingestible medicaments such as aspirin or the like. These medicaments, however, are not always effective, and further, merely mask the symptoms rather than alleviate the problem. Moreover, many individuals are incapable of using these medicaments due to allergic reaction to the particular substance ingested.

External manual massage or acupressure of the trigger area of menstrual cramping have proven to provide temporal relief. Gach, *Acupressure's Potent Points: A Guide To Self-Care For Common Ailments*, p. 168–169 (1990); Cummings, *Myofascial Pain and Dysfunction: The Trigger Point Manual*, p. 665 (1988); Lark, *Premenstrual Syndrome Self-Help Book: A Woman's Guide To Feeling Good All Month*, p. 176, 194(1984); and *A New View of a Woman's Body*, p. 98–99(1981). This technique directly massages cramps or abdominal discomfort originating in the uterine and/or lower back regions. Uterine massage may facilitate removal of blood clots in the uterus, and thus relieve cramps, while lower back massage helps relieve tension caused by pressure on the nerves and spinal column. (See *A New View* at p. 99).

The problem with this approach, however, is that the application of continuous manual massage is nearly impossible if one is to function normally throughout the day. Thus, there has been a need for an externally applied apparatus and method for reducing menstrual cramping and associated abdominal discomfort.

DISCLOSURE OF INVENTION

Accordingly, it is an object of the present invention to provide an undergarment apparatus and method which reduces menstrual cramping.

Another object of the present invention to provide an undergarment apparatus and method for reducing menstrual cramping which is comfortable in application.

Still another object of the present invention is to provide an undergarment apparatus and method which continuously applies comforting localized or point pressure in the menstrual cramping region.

It is a further object of the present invention to provide an undergarment apparatus and method for reducing menstrual cramping which is low in cost, durable, compact, easy to maintain, has a minimum number of components, and is easy to use by unskilled personnel.

In accordance with the foregoing objects, an undergarment apparatus for reducing menstrual cramping is provided comprising an underpant brief including a circumferential upper edge to be situated at a vertical position proximate the waist of an individual wearer. The brief further includes a front portion, a rear portion, a crotch portion, and spaced-apart leg openings separated by the crotch portion. An elastic panel is mounted to at least one of the front portion and the rear portion in a manner exerting inward pressure across the lower torso region of the individual wearer. At least one movable pressure bearing insert is formed for positioning between the elastic panel and the lower torso region at a plurality of positions along the elastic panel. The pressure bearing insert includes a side having a relatively small area or apex portion formed to face toward the torso region. The elastic panel cooperates with the pressure pad to exert substantial localized or point pressure on an area of menstrual cramping in the torso region for mitigation thereof. A mounting device couples the backside of the insert to one of the front elastic panel and the rear elastic panel for removable, rotation-free mounting thereto.

In another aspect of the present invention, a method of mitigating body aches caused by menstrual cramping of an individual comprising the steps of: mounting an elastic panel to at least one of the front portion and the rear portion of an individual wearer in a manner exerting inward pressure across the lower torso region of the wearer; and positioning at least one movable pressure bearing insert between the elastic panel and the lower torso region at a selected one of a plurality of positions along the elastic panel. The pressure bearing insert having an apex portion or small area side formed to face towards the torso region, and the elastic panel cooperating with the pressure pad to exert substantial localized or point pressure on a relatively small area of the torso region of the wearer in which menstrual cramping is occurring for mitigation thereof. Finally, mounting the backside of the insert to one of the front elastic panel and the rear elastic panel for removable, rotation-free mounting thereto through a mounting device.

BRIEF DESCRIPTION OF THE DRAWING

The assembly of the present invention has other objects and features of advantage which will be more readily apparent from the following description of the Best Mode of Carrying Out the Invention and the appended claims, when taken in conjunction with the accompanying drawing, in which:

BEST MODE OF CARRYING OUT THE INVENTION

Figure 6:
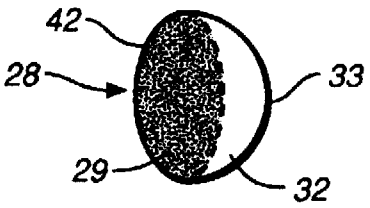
FIG. 6 is a side perspective view of a pressure pad of the present invention.
Figure 2:
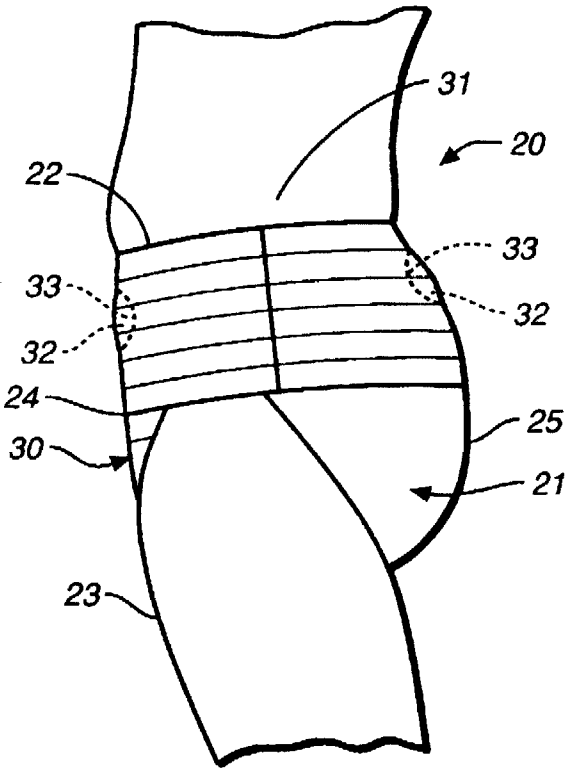
FIG. 2 is a reduced, fragmentary side elevation view of the undergarment apparatus of FIG. 1 and illustrating the positioning of the front and rear pressure pads.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Attention is now directed to FIGS. 1–4 where an undergarment apparatus, generally designated 20, for reducing menstrual cramping is shown including an underpant brief, generally designated 21, having a circumferential upper edge 22 to be situated at a vertical position proximate the waist of an individual wearer 23. Underpant brief 21 further includes a front portion 24 and a rear portion 25 which depend downwardly from edge 22 and are connected together by a crotch portion 26. The front, rear and crotch portions define spaced-apart leg openings 27, 27' separated by the crotch portion. An elastic panel member 30 is mounted to at least one of front portion 24 and rear portion 25 in a manner exerting inward pressure across the lower torso region 31 of the individual wearer. At least one movable pressure bearing insert, generally designated 32, is formed for positioning between elastic panel 30 and the lower torso region at a plurality of positions along the elastic panel. Pressure bearing insert 32 includes an apex portion or side of relatively small area 33 (FIG. 6) formed to face toward torso region 31. The elastic panel cooperates with the pressure pad to exert substantial localized pressure on a relatively small area of menstrual cramping in the torso region of the wearer for mitigation thereof. A mounting device, generally designated 28, couples the backside of insert 32 to one of the elastic panels for removable, rotation-free mounting thereto.

Accordingly, by applying substantial inward radial pressure, supplied by elastic panel 30 across the lower torso region 31, the movable pressure bearing insert 32 can be applied to the specific areas of menstrual cramping. This novel arrangement continuously exerts pressure against the desired locality to induce external support and massaging of cramping muscle. Such continuous point pressure results in relief of menstrual cramping in the massaged region.

It will be understood that the terms "point pressure" and "localized pressure" refer to a concentrated region of local pressure rather than literally a single point of pressure. Hence, because pressure bearing inserts 32 are preferably provided by slightly compressible pressure pads 32, as will be described, and apex portion 33 which causes the point or localized pressure is preferably rounded or convex on one side (FIG. 5), the pressure or support created will be in a relatively small area or region or a localized point pressure.

In the preferred form, elastic panel 30 is separated into three portions: a front waist panel 34; a rear waist panel 35; and a pubic region panel 36. It will be appreciated, however, that only one panel or a combination thereof may be employed without departing from the true spirit and nature of the present invention. Further, it will be understood that the elastic panel can be provided by any elastic material sufficiently resilient to induce a significant inward radial pressure or compressive force toward the torso region or the pubic region.

Figure 1:
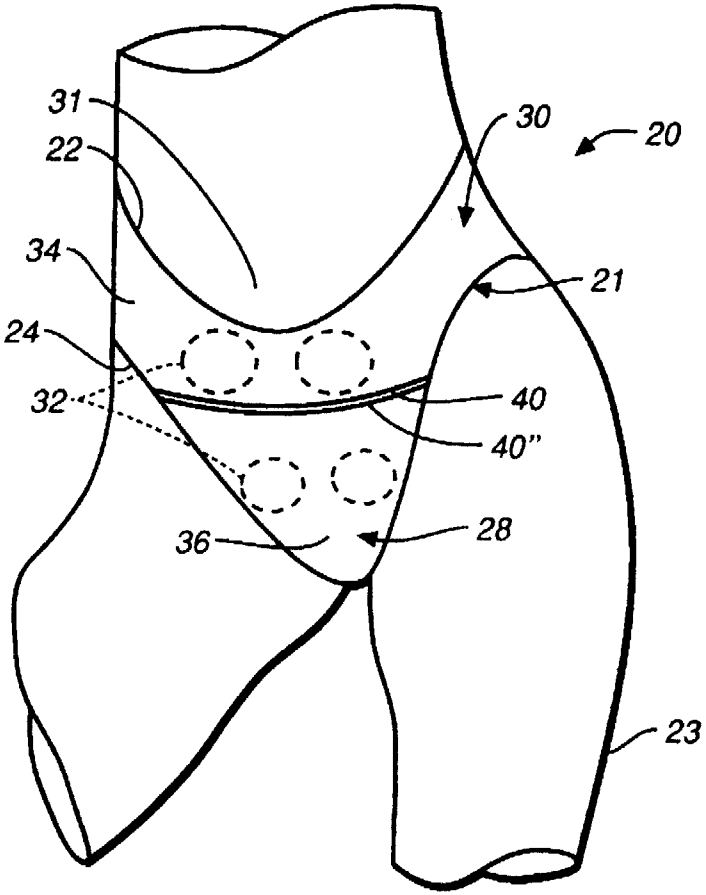
FIG. 1 is a fragmentary front perspective view of the undergarment apparatus for reducing menstrual cramping constructed in accordance with the present invention and worn by an individual.
Figure 3:
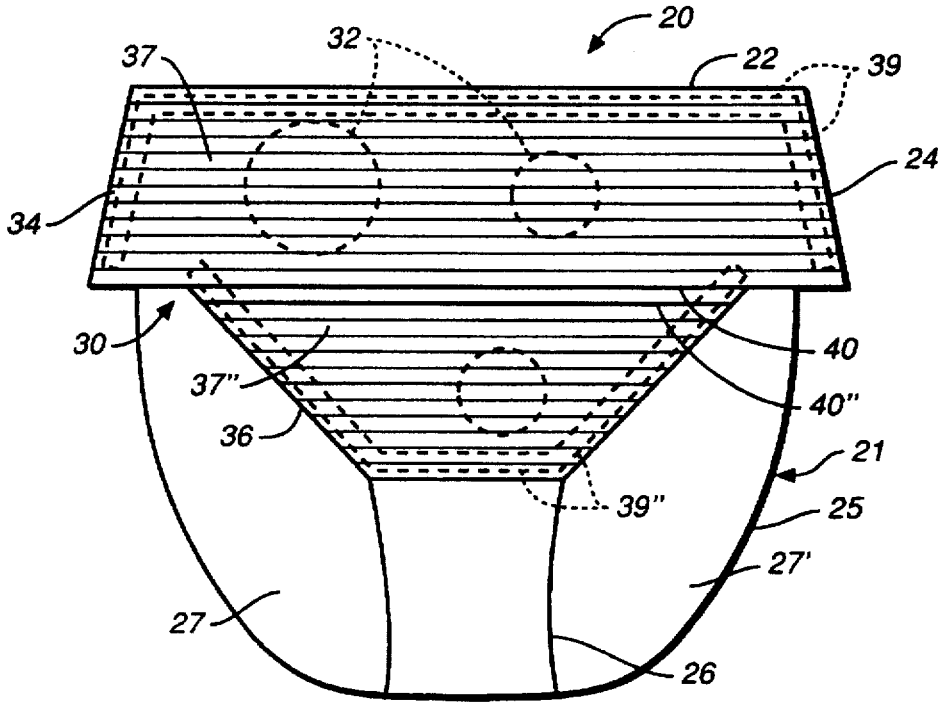
FIG. 3 is an enlarged, front elevation view of the undergarment apparatus of FIG. 1 and illustrating placement of the pressure pads at a plurality of positions.
Figure 5:
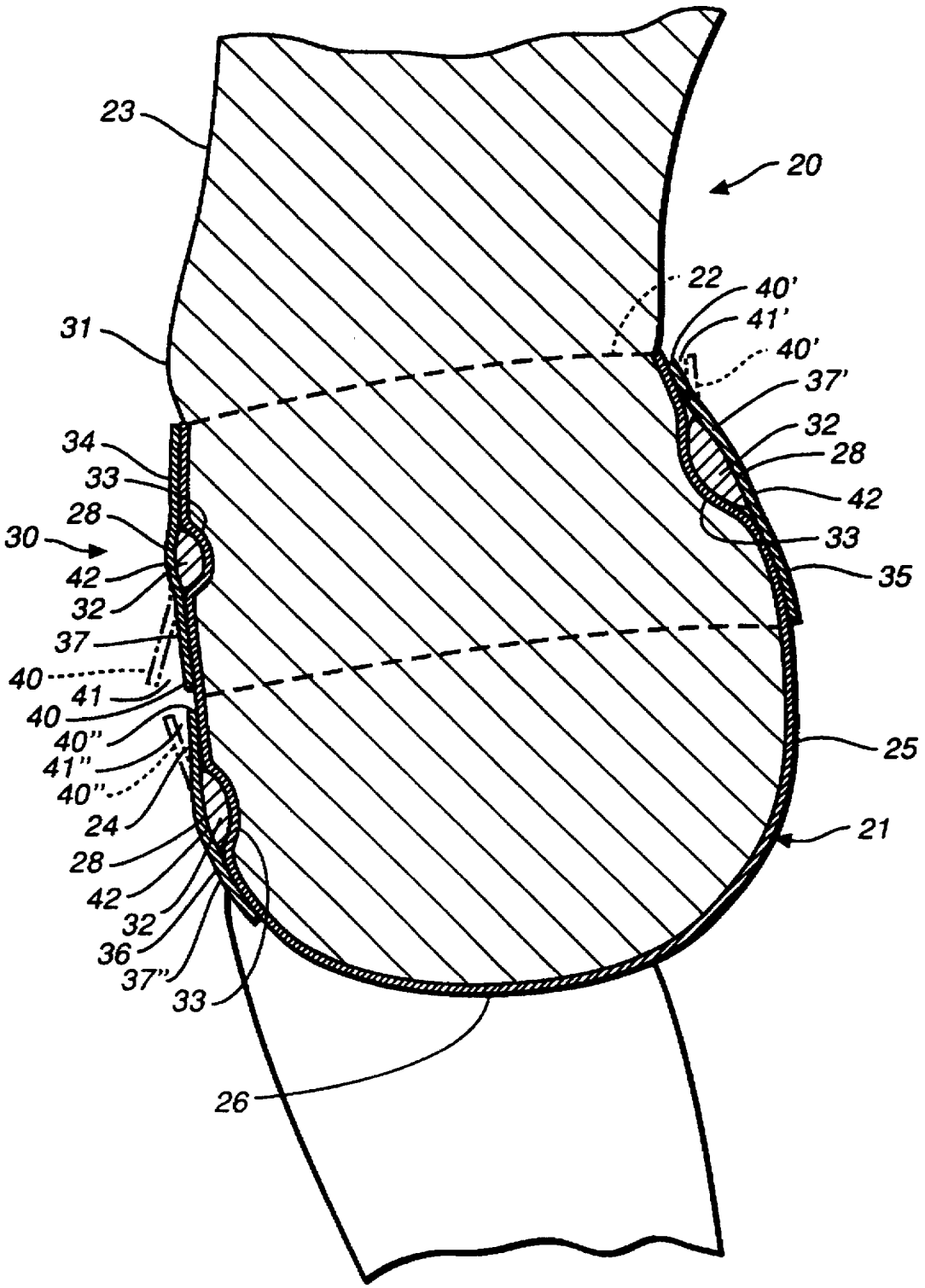
FIG. 5 is an enlarged side elevation view, in cross-section, of the undergarment apparatus of FIG. 2 and illustrating the localized point pressure provided by the pressure pads.

Turning now to FIGS. 1, 3 and 5, it can be viewed that front waist panel 34 extends transversely across brief front portion 24 to a position proximate brief circumferential upper edge 22. This substantially resilient elastic panel 30 is mounted to the brief front portion which together cooperate to induce inward radial pressure at the upper front waist portion of the individual wearer 23. In the preferred embodiment, pressure pads 32 are placed between front waist panel 34 and brief front portion 24 (FIG. 5) so that the pads can be retainably positioned therebetween. As will be described, the pads can be oriented at a plurality of positions relative the torso to concentrate local point pressure on the particular region of torso discomfort or menstrual cramping. Mounting device 28, subsequently, removably affixes pad or insert 32 to the elastic panel for rotational-free mounting.

Preferably, the front waist panel 34 is peripherally sewn to underpant brief 21 by stitching 39 to form at least one front pocket 37 therebetween. One edge 40 of the front waist panel, however, is not sewn to underpant brief 21 to form an access opening 41 into the pocket. Hence, by manually gripping edge 40 and pulling it away from the front portion of underpant brief 21 (shown in phantom lines in FIG. 5), the access opening 41 can be widened or enlarged for insertion of pressure pads 32 therein at a plurality of positions about the front portion of the underpants.

After proper positioning of the pressure pads over the region of abdominal pain or menstrual cramping and upon release of edge 40, the elastic panel will resiliently press pressure pad 32 against the undergarment front portion 24 in a manner continuously maintaining pressure on the region of menstrual pain for support and massage thereof. As mentioned such applied pressure will effectively reduce local discomfort caused by menstruation.

As best viewed in FIG. 6, pressure pads 32 are preferably semi-spherical shaped having a curved apex portion 33 and a base surface 42. The pressure pads are situated in front pocket 37 in a manner positioning the base surface 42 in contact with front waist panel 34 so that apex portion 33 will be facing toward the torso of the individual wearer. This configuration concentrates the pressure created by the elastic panel at the pad apex portion to cause localized point pressure on the region of abdominal pain.

In the preferred form, mounting device 28 is provided by hook and loop material (i.e., VELCRO®) positioned between the insert backside and the elastic panels facing the interior of the respective pockets. Preferably the hook material 29 is mounted to the insert backside, while the loop material is mounted to or part of the elastic panel. It will be appreciated, however, that other mounting elements may be employed for rotation-free mounting therebetween without departing from the true spirit an nature of the present invention.

Figure 4:
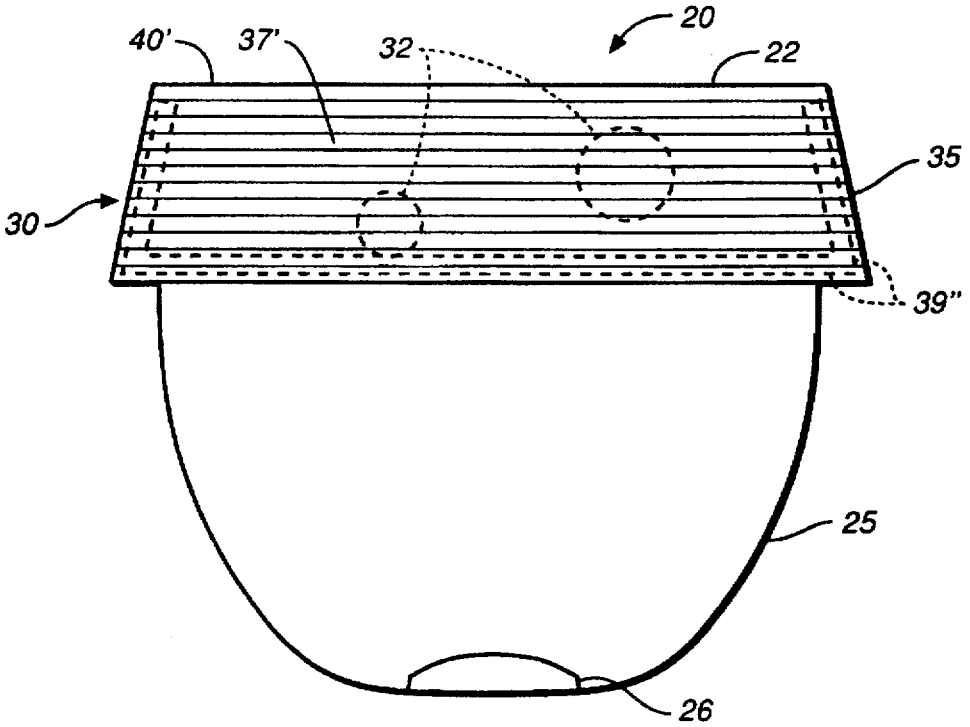
FIG. 4 is an enlarged rear elevation view of the undergarment apparatus of FIG. 1.

It will be appreciated that a plurality of pressure pads may be positioned in any one pocket 37, 37' and 37", as viewed in FIGS. 3 and 4, to alleviate pain in multiple regions of the torso and pubic region. Pressure pads 32 are preferably composed of a semirigid, but sufficiently resilient foam or sponge-foam latex rubber material being slightly compressible to conform base surface 42 with the elastic panel, while further being sufficiently firm to cause concentrated local point pressure at the region of abdominal pain or menstrual cramping. As above-mentioned, since the pressure pads are slightly compressible, the contact region between apex portion 33 and the torso will be expanded upon contact with brief front portion 24 to create a region of localized point pressure (FIG. 5). Further, it will be understood that the pressure pads may be provided in different sizes (FIGS. 3 and 4) to accommodate greater or smaller regions of pain or discomfort. The pressure bearing inserts, however, may also be a substantially rigid member which exert localized point pressure on the torso.

As mentioned elastic panel 30 further provides rear waist panel 35 and pubic region panel 36 which is also mounted to brief rear portion 25 and brief front portion 24, respectively, in a manner creating inward radial pressure toward the rear torso and pubic region of the individual wearer. Similar to the front waist panel 34, the rear waist panel and the pubic region panel are peripherally sewn to underpant brief 21 to form rear pocket 37' and pubic pocket 37"respectively, via stitching 39', 39". These pockets receiving pressure of receiving pressure pads 32 at a plurality of positions therein. Both the rear waist panel and the pubic region panel include an edge 40', 40" (shown in phantom lines in FIG. 5) which forms an access opening 41', 41" into pocket 40', 40", respectively.

Figure 7:
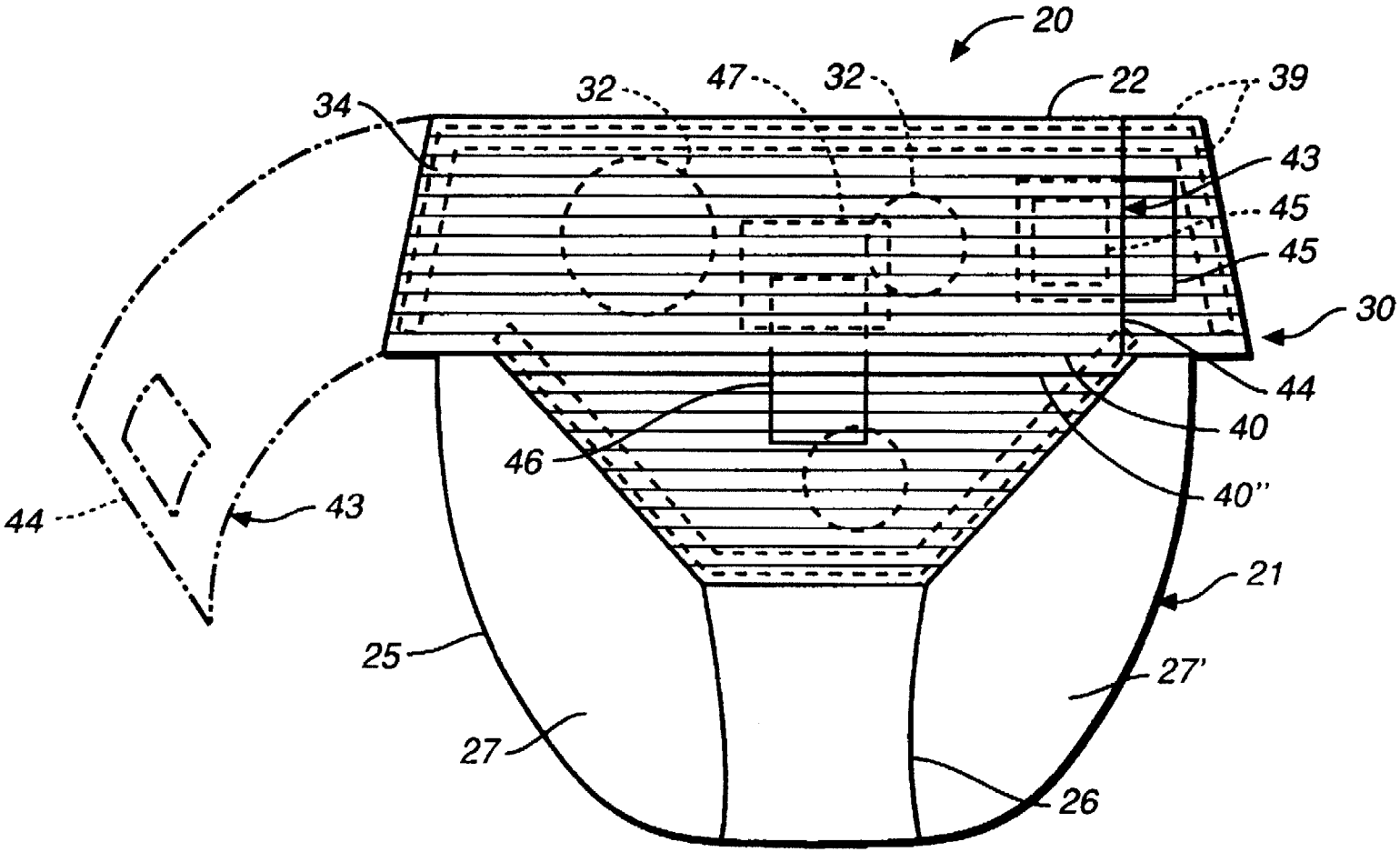
FIG. 7 is a front elevation view of an alternative embodiment of the undergarment apparatus of the present invention having mounting straps.

In an alternative embodiment, as shown in FIG. 7, a resilient strap 43 may be mounted to the elastic panel to further promote local point pressure caused by the pressure pad. One end of the straps may be sewn to the underpant brief or elastic panel while an opposite end 44 releasably mounts to an exterior portion of the elastic panel through VELCRO® hook and loop strips 45 or the like. Further, a closing strap 46 may be included to close pockets 37, 37" using VELCRO® strips 47. These straps, of course, can be mounted at a plurality of positions about the elastic panels.

Figure 8:
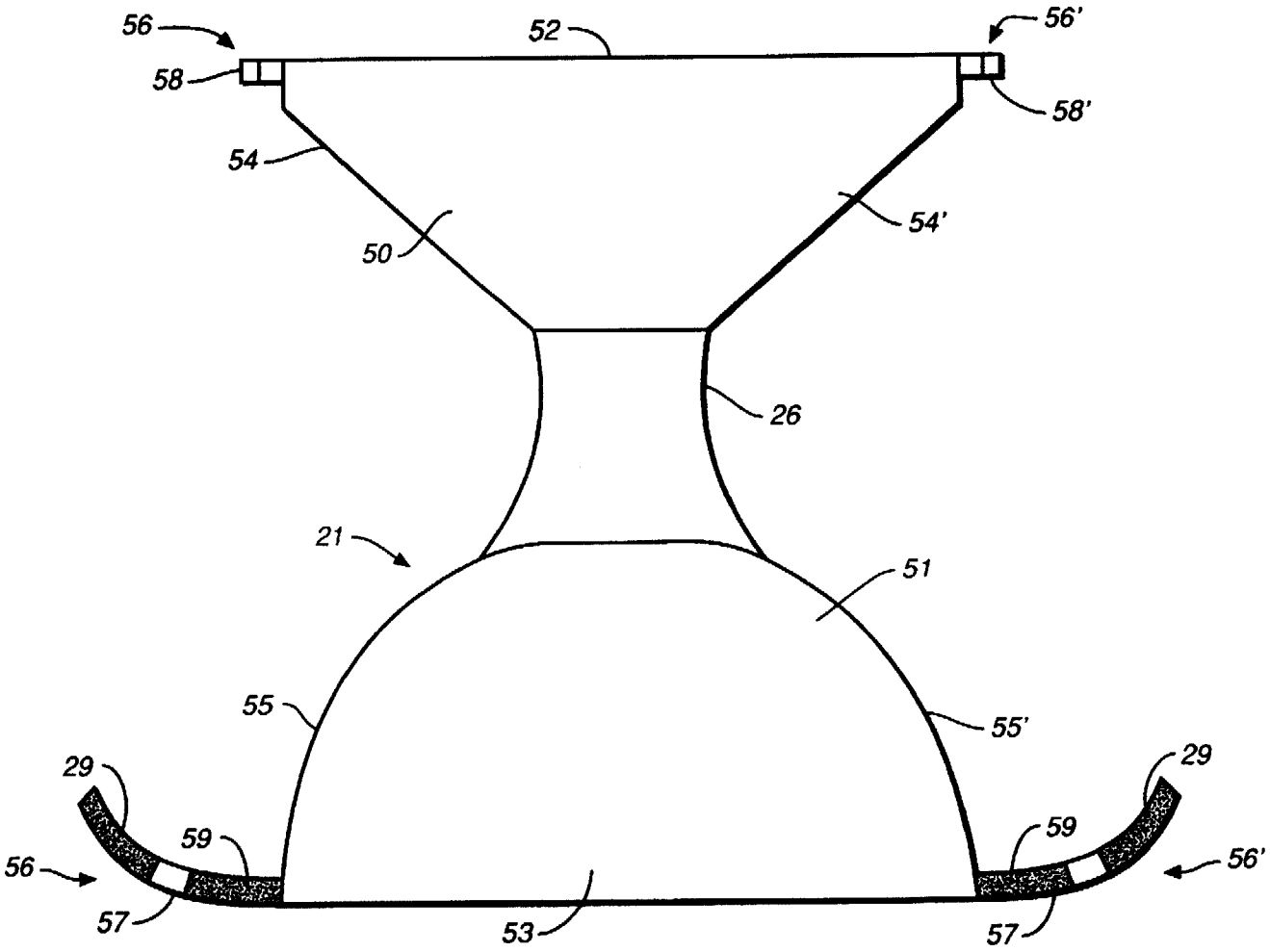
FIG. 8 is a top plan view of an alternative embodiment of the undergarment apparatus of the present invention in an unfolded position.

FIG. 8 illustrates another alternative embodiment of the present invention which provides underpant brief 21 in a diaper-form for easy installation. Underpant brief 21 includes a front sheet or panel 50, a rear sheet or panel 51 and a crotch portion 26. Each of the front panel 50 and rear panel 51 include respective upper portions 52, 53; side portions 54, 55; and opposite side portions 54', 55'. A crotch portion 26 connects a bottom portion of front panel 50 to a bottom portion of rear panel 51.

In accordance with this alternative embodiment of the present invention, a pair of coupling devices 56, 56' removably couple front panel 50 to rear panel 51 proximate the upper portions 52, 53, respectively, thereof. In particular, coupling device 56 removably couples the front panel side portion 54 to the rear panel side portion 55, while coupling device 56' removably couples the front panel opposite side portion 54' to the rear panel opposite side portion 55'.

Accordingly, brief 21 is formed as a diaper-type undergarment, as shown in FIG. 8. Coupling devices 56, 56' cooperate with the front panel 50 and rear panel 51 in a manner exerting inward pressure across the lower torso region of the individual wearer. Moreover, this coupled arrangement defines a circumferential upper edge to be situated at a vertical position proximate the waist of an individual wearer when worn. The side portions and opposite side portions cooperate to form spaced-apart leg openings separated by crotch portion 26.

Similar to the previous embodiments, a freely movable, detached, pressure bearing insert 32 is included having a backside substantially smaller in area than either the front panel 50 and rear panel 51. This size arrangement enables selective placement of the insert at a plurality of spaced positions relative the front panel and the rear panel between proximate upper portion of the brief to proximate the crotch portion. A mounting device 28 is included coupling the backside of insert 32 to either the front panel or the rear panel for removable, rotation-free mounting.

As previously mentioned, the front and rear panels cooperate with and substantially contact the backside of the pressure bearing insert to exert substantial, continuous, localized pressure on an area of menstrual cramping in the torso region for mitigation thereof.

In the preferred embodiment, coupling devices 56, 56' are provided by VELCRO® straps 57, 57', having hook material 29 proximate the end thereof, and loop material 59 proximate the opposite end thereof or on the panels themselves. The straps 57, 57' are mounted to the side portion 55 and opposite side portion 55' of rear panel 51, respectively. Each side portion 54, 54' of front panel may include a plastic loop 58, 58' or the like formed for receipt of straps 57, 57'. Subsequently, the VELCRO® straps are tightened, through pulling, to mount the garment to the user which exerts inward pressure across the lower torso region of the individual wearer.

Alternatively, the hook material of straps 57, 57' may be affixed directly to the front panel material. In this instance, the panel will include an inner material capable of removably attaching to the hook material (i.e., a loop material). This further enables the backside of insert 32 to mount thereto (via, mounting device 28). Moreover, this embodiment may include front and rear pocket portions similar to the previously described embodiments.

The front and rear panels in this embodiment may be further substantially elastic to facilitate the generation of inward pressure toward the user's torso after the straps have been engaged. Additionally, the straps themselves may be elastic as well.

A method of mitigating body aches caused by menstrual cramping of an individual is provided comprising the steps of: mounting an elastic panel 30 to the lower torso region of an individual wearer, preferably by means of a brief 21 worn by the wearer; and positioning at least one movable pressure pad 32 between elastic panel 30 and the lower torso region of the user at a selected one of a plurality of positions along elastic panel 30. The pressure pad 32 has apex portion or relatively small area side 33 formed to face towards the torso region, and the elastic panel cooperates with pressure pad 32 to exert substantial localized or point pressure on an area of menstrual cramping in the torso region for mitigation thereof. Finally, mounting the backside of the insert 32 to one of the front elastic panel and the rear elastic panel for removable, rotation-free mounting thereto through a mounting device 28.

The method further preferably includes the step of mounting a pressure pad in at least one front pocket 37 in brief 21, dimensioned for receipt and retainment of pressure pad 32 therein between elastic panel 30 and brief front portion 24, and mounting another pressure pad 32 in at least one rear pocket 37' dimensioned for receipt and retainment of the other pressure pad 32 therein between elastic panel 30 and rear portion 25.

What is claimed is:

1. An undergarment apparatus for reducing menstrual cramping comprising:

an underpant brief including a circumferential upper edge to be situated at a vertical position proximate the waist of an individual wearer, a front portion and a rear portion each depending downwardly from said upper edge, and a crotch portion connecting said front portion and said rear portion and defining therewith spaced-apart leg openings separated by said crotch portion;

a front elastic panel mounted to said front portion and a rear elastic panel mounted to said rear portion in a manner exerting inward pressure across the lower torso region of said individual wearer;

at least one freely movable, detached, pressure bearing insert having a backside substantially smaller in area than one of the front elastic panel and rear elastic panel to enable selective placement at a plurality of spaced positions relative one of the front elastic panel and the rear elastic panel between proximate an upper portion of said brief to proximate said crotch portion, said pressure bearing insert having an apex portion formed to face towards said torso region, and the respective front and rear elastic panels cooperating with and substantially contacting said backside of said pressure bearing insert to exert substantial, continuous, localized pressure on an area of menstrual cramping in said torso region for mitigation thereof; and a mounting device coupling the backside of said insert to said one of the front elastic panel and the rear elastic panel for removable, rotation-free mounting.

2. The undergarment apparatus as defined in claim 1 wherein, said mounting device is provided by hook and loop material.

3. The undergarment apparatus as defined in claim 2 wherein, one of said hook and loop material is mounted to the insert backside, while the other of said hook and loop material is mounted to the front elastic panel and the rear elastic panel.

4. The undergarment apparatus as defined in claim 1 wherein, said elastic panel and said one of said front portion and said rear portion cooperate to define at least one pocket formed for receipt and retainment of said one pressure bearing insert therein.

5. The undergarment apparatus as defined in claim 1 wherein, said front elastic panel and said front portion cooperate to define at least one front pocket having an opening for access therein, and formed for receipt and retainment of said one pressure bearing insert therein; and said rear elastic panel and said rear portion cooperate to define at least one rear pocket having an opening for access therein, and formed for receipt and retainment of at least one other pressure bearing insert therein.

6. The undergarment apparatus as defined in claim 1 wherein, said one pressure bearing insert is a pressure pad formed of a substantially resilient compressible material.

7. The undergarment apparatus as defined in claim 6 wherein, said one pressure pad is comprised of foam.

8. The undergarment apparatus as defined in claim 1 wherein, said one pressure bearing insert is semi-spherical-shaped.

9. The undergarment apparatus as defined in claim 8 wherein, said one pressure bearing insert is a pressure pad formed of a substantially resilient compressible material.

10. A method of mitigating body aches caused by menstrual cramping of an individual comprising the steps of:

providing an underpant brief including a circumferential upper edge to be situated at a vertical position proximate the waist of an individual wearer, an elastic front panel and an elastic rear panel each depending downwardly from said upper edge, and a crotch portion connecting said front panel and said rear panel and defining therewith spaced-apart leg openings separated by said crotch portion, said front panel and said rear panel cooperating to exert inward pressure across the lower torso region of said individual wearer;

selectively positioning at least one movable, detached, pressure bearing insert at a plurality of spaced positions along one of the front panel and the rear panel between proximate an upper portion of said brief to proximate said crotch portion, said pressure bearing insert having a relatively small area apex portion and being positioned with said apex portion facing towards said torso region, and said elastic panel cooperating with and substantially contacting a backside of said pressure bearing insert to exert substantial, continuous, localized point pressure on an area of menstrual cramping in said torso region for mitigation thereof; and mounting the backside of said insert to said one of the front elastic panel and the rear elastic panel for removable, rotation-free mounting through a mounting device.

11. The method as defined in claim 10 wherein, said positioning step is accomplished by positioning said one pressure bearing insert in at least one pocket provided in said brief along one of said front panel and said rear panel, said pocket being dimensioned for receipt and retainment of said one pressure bearing insert at said plurality of positions.

12. The method as defined in claim 10 wherein, said positioning step is accomplished by positioning a pressure bearing insert formed of a substantially resilient compressible material between said elastic panel and said lower torso region.

13. The method as defined in claim 10 further including the step of:

prior to said mounting step, forming said front panel with at least one front pocket dimensioned for receipt and retainment of said one pressure bearing insert therein;

prior to said mounting step, forming said rear panel with at least one rear pocket dimensioned for receipt and retainment of at least one other pressure bearing insert therein; and during said mounting step, wearing said undergarment over said lower torso region.

14. The method as defined in claim 13 wherein, said positioning step is accomplished by positioning pressure bearing inserts formed of a substantially resilient compressible material in said front pocket and in said rear pocket.

15. The method as defined in claim 10 wherein, said mounting device is provided by hook and loop.

16. An undergarment apparatus for reducing menstrual cramping comprising:

an underpant brief including a circumferential upper edge to be situated at a vertical position proximate the waist of an individual wearer, a front portion and a rear portion each depending downwardly from said upper edge, and a crotch portion connecting said front portion and said rear portion and defining therewith spaced-apart leg openings separated by said crotch portion;

a front elastic panel mounted to said front portion, said front elastic panel and said front portion cooperating to define a front upper pocket and a front lower pocket each having access openings thereto;

a rear elastic panel mounted to said rear portion in a manner exerting inward pressure across the lower torso region of said individual wearer, said rear elastic panel and said rear portion cooperating to define at least one rear pocket having an opening thereto;

at least one freely movable, detached, pressure bearing insert having a backside substantially smaller in area than one of the front elastic panel and rear elastic panel to enable selective placement at a plurality of spaced positions relative one of the front elastic panel and the rear elastic panel between proximate an upper portion of said brief to proximate said crotch portion, said pressure bearing insert being formed for selective insertion into said front upper pocket and said front lower pocket and said rear pocket, and said pressure bearing insert having an apex portion formed to face towards said torso region, and the respective front and rear elastic panels cooperating with and substantially contacting said backside of said pressure bearing insert to exert substantial, continuous, localized pressure on an area of menstrual cramping in said torso region for mitigation thereof; and a mounting device coupling the backside of said insert to said one of the front elastic panel and the rear elastic panel for removable, rotation-free mounting.

17. The undergarment apparatus as defined in claim 16 wherein, the front elastic panel of said lower pocket being formed to extend substantially across the pubic bone region of said individual; and the front elastic panel of said upper pocket being formed to extend substantially across the remaining front waist portion of said individual.

18. An undergarment apparatus for reducing menstrual cramping comprising:

an underpant brief including a circumferential upper edge to be situated at a vertical position proximate the waist of an individual wearer, a front portion and a rear portion each depending downwardly from said upper edge, and a crotch portion connecting said front portion and said rear portion and defining therewith spaced-apart leg openings separated by said crotch portion;

a front elastic panel mounted to said front portion and a rear elastic panel mounted to said rear portion in a manner exerting inward pressure across the lower torso region of said individual wearer;

at least one freely movable, detached, pressure bearing insert having a backside substantially smaller in area than one of the front elastic panel and rear elastic panel to enable selective placement at a plurality of spaced positions relative one of the front elastic panel and the rear elastic panel between proximate an upper portion of said brief to proximate said crotch portion, said pressure bearing insert having an apex portion formed to face towards said torso region, and the respective front and rear elastic panels cooperating with and substantially contacting said backside of said pressure bearing insert to exert substantial, continuous, localized pressure on an area of menstrual cramping in said torso region for mitigation thereof;

a mounting device coupling the backside of said insert to said one of the front elastic panel and the rear elastic panel for removable, rotation-free mounting; and a mounting strap having one end mounted to said underpant brief and having an opposite end releasable mounted to said elastic panel.

19. The undergarment apparatus as defined in claim 18 wherein, said strap is releasably mounted to said elastic panel by a hook and loop fastener assembly.

* * * * *